United States Patent [19]

Bauder

[11] Patent Number: 4,903,670

[45] Date of Patent: Feb. 27, 1990

[54] CONTROL DEVICE FOR A DIESEL INTERNAL COMBUSTION ENGINE

[75] Inventor: Richard Bauder, Neckarsulm, Fed. Rep. of Germany

[73] Assignee: Audi AG, Fed. Rep. of Germany

[21] Appl. No.: 159,065

[22] Filed: Feb. 23, 1988

[30] Foreign Application Priority Data

Feb. 25, 1987 [DE] Fed. Rep. of Germany ..... 3705972

[51] Int. Cl.[4] ..... F02M 39/00

[52] U.S. Cl. ..... 123/489; 123/359; 123/198 DB

[58] Field of Search ..... 123/489, 198 DB, 179 L, 123/357, 358, 359, 198 D

[56] References Cited

U.S. PATENT DOCUMENTS

| | | | |
|---|---|---|---|
| 4,023,358 | 5/1977 | Maurer | 123/198 DB |
| 4,077,381 | 3/1978 | Firey | 123/198 DB |
| 4,083,337 | 4/1978 | Hattori | 123/198 DB |
| 4,498,443 | 2/1985 | Hasegawa | 123/198 DB |
| 4,509,480 | 4/1985 | Kull | 123/198 DB |
| 4,515,125 | 5/1985 | Buck | 123/198 DB |
| 4,648,370 | 3/1987 | Kobayashi | 123/489 |
| 4,662,335 | 5/1987 | Kleeblatt | 123/489 |
| 4,697,567 | 10/1987 | Sawaad | 123/489 |
| 4,715,344 | 12/1987 | Tomisawa | 123/489 |

FOREIGN PATENT DOCUMENTS 3127038 1/1983 Fed. Rep. of Germany ..... 123/489

*Primary Examiner*—Carl Stuart Miller

*Attorney, Agent, or Firm*—Kane, Dalsimer, Sullivan, Kurucz, Levy, Eisele and Richard

[57] ABSTRACT

A diesel internal combustion engine 1 has an air intake 2, an injection pump 3 and an exhaust pipe 4. In the fuel injection line 7 is arranged an electromagnetic shut-off valve 8, which closes the fuel supply when the "ignition" switch 10 is turned off, in order to bring the engine 1 to an immediate halt. In the exhaust pipe 4 is arranged a lambda lean probe 12, which feeds to a comparator electronics system 14 a signal corresponding to the oxygen content of the exhaust gas; this signal is compared in the comparator circuit with a lambda nominal value. If an excess quantity of fuel has been injected, for example, due to a fault in the injection system the value detected by the lambda probe 12 will fail to reach the nominal value, whereupon the comparator electronic system 14 activates a switch 15 in the control line 9 of the shut-off valve 8. The current supply to the shut-off valve 8 is interrupted and the fuel supply to the engine 1 is shut off. In this way unintentional acceleration of the engine as a result of faulty injection of an excess quantity of fuel, is prevented.

1 Claim, 2 Drawing Sheets

FIG. 1
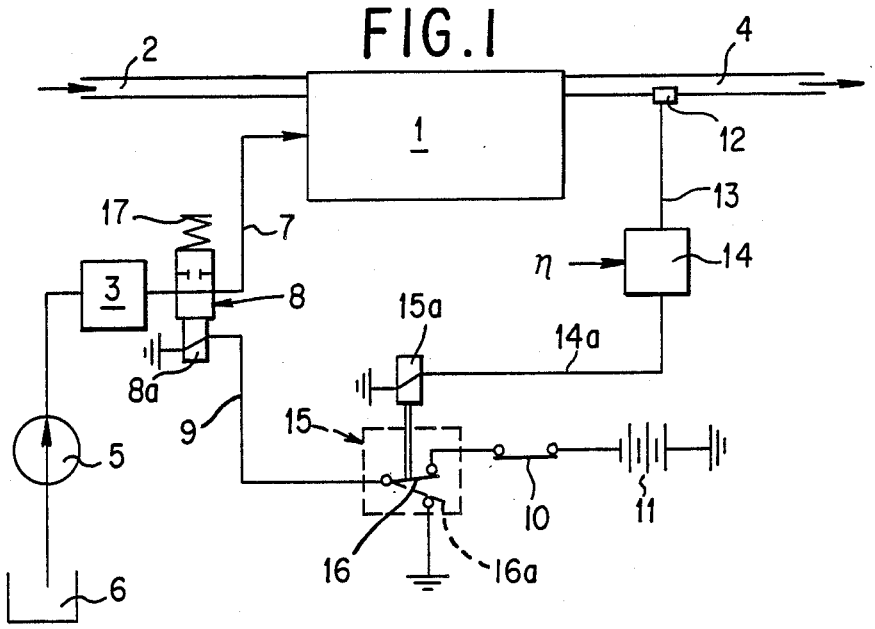
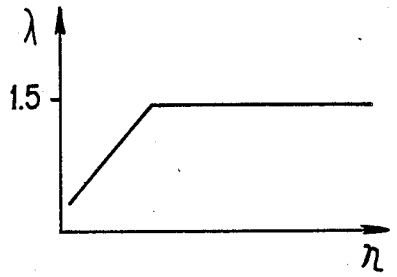
FIG. 2
FIG. 3
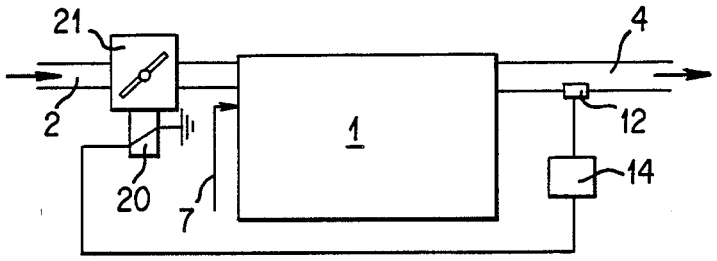
FIG. 4
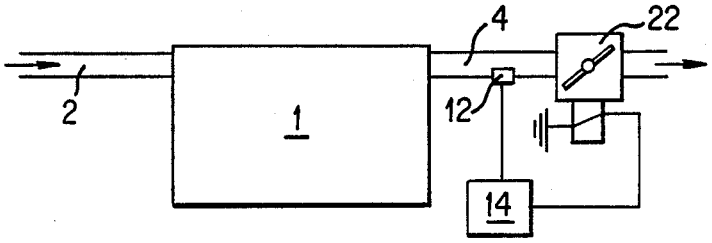

CONTROL DEVICE FOR A DIESEL INTERNAL COMBUSTION ENGINE

This invention relates to a control for a diesel engine of the type having an air intake, a fuel injection pump, an exhaust pipe, and a device for bringing the engine to a standstill, for example, a solenoid valve in the fuel supply line or a shut-off valve in the air intake or the exhaust pipe.

Many devices exist for bringing an engine to a standstill, for example, by cutting off the fuel supply when a permitted maximum speed is reached. However these known devices are not able to switch off the engine below the maximum speed, if the quantity of fuel injected suddenly increases without any action on the part of the operator. In the case of mechanical fuel injection systems this can be caused, for example, by a defect in the regulator such as spring breakage, or in the case of electronic fuel injection systems, by the failure of one or more electronic components.

An object of the invention is to provide a diesel engine control device which can detect when an excess quantity of fuel is injected and then rapidly bring the engine to a standstill.

Broadly stated the invention consists in a diesel internal combustion engine of the type having an air intake, a fuel injection pump, an exhaust pipe, and a device for bringing the engine to a standstill, including a control comprising a lambda lean probe in the exhaust pipe and an electronic comparator circuit arranged to compare the oxygen content of the exhaust gases as ascertained by the lambda lean probe with a nominal lambda value, and to actuate the engine stop device if the oxygen content falls below the nominal value.

The invention is based on the appreciation that in the event of an excessive quantity of fuel being injected, as may occur with a faulty injection system, the quantity of air lambda in the exhaust gas is reduced almost instantly. By using a lambda lean probe the oxygen content in the exhaust gas at a level above lambda=1 can also be determined. The nominal or standard lambda value, which may differ from engine to engine and may reach lambda=1.5, for example, is stored in an electronic comparator circuit and if the value is exceeded this is proof that an excess quantity of fuel has been injected, and the comparator electronics then activates the device for bringing the engine to a standstill. This stop device, in a particular preferred simple case, is an electromagnetically operated shut-off valve in the fuel line. This is normally provided in every diesel fuel injection system and serves to cut off the fuel supply instantly and to shut down the engine when the "ignition switch" is turned off. In such a case, all that is needed in the circuit of the shut-off valve, is a two-way switch in series with the ignition switch, arranged to be actuated by the comparator electronics and to break or earth the circuit of the shut-off valve.

Particularly in diesel engines used to drive motor vehicles, it is normal to inject an excess of fuel for starting, which leads to a corresponding reduction of the lambda value in the exhaust gas. It may be of advantage therefore in order to avoid bringing the engine to a standstill unintentionally, to store in the comparator electronics a characteristic curve of speed-dependent lambda nominal values, and to arrange for a speed-dependent signal to be fed to the electronics system so as to determine the permitted lambda nominal value for the instantaneous speed, with which value the signal of the lambda lean probe has to be compared. Alternatively, a timer may be provided, activated automatically when the engine is started to prevent the engine being brought to a halt for a certain length of time after starting if the actual lambda value is below the lambda nominal value owing to an excess quantity of fuel.

The invention may be performed in various ways and one specific embodiment with some possible modifications will now be described by way of example with reference to the accompanying drawings, in which:

FIG. 1 is a circuit diagram of a control device according to the invention;

FIG. 2 is a diagram illustrating the lambda nominal value against the speed n; and FIGS. 3, 4 and 5 are diagrams showing modifications of the embodiment of FIG. 1.

Figure 5:
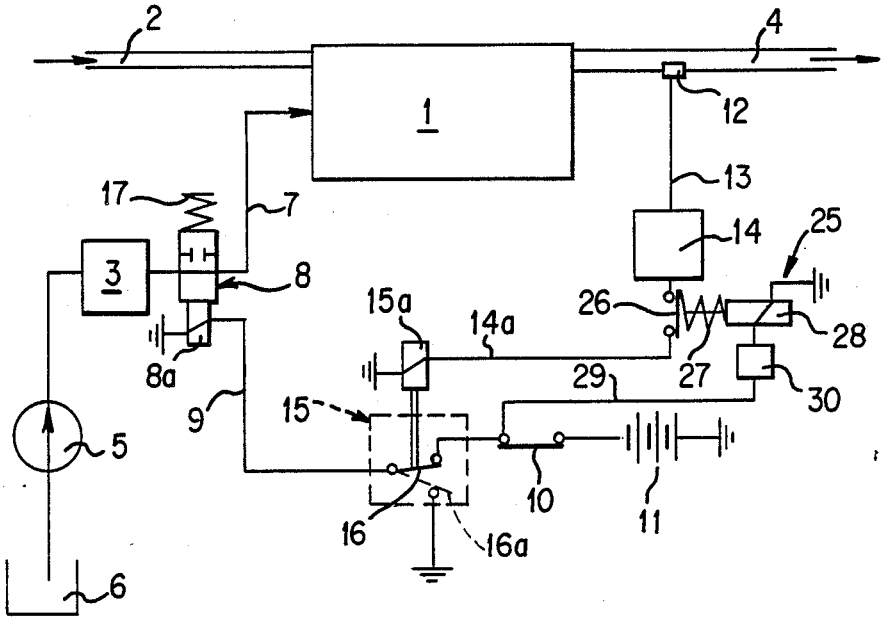

In the example of FIG. 1 a diesel engine 1 has an air intake pipe 2, a fuel injection pump 3 and an exhaust pipe 4. The fuel is pumped from tank 6 by a fuel pump 5 and thence to the injection pump 3, which controls the timing and quantity of fuel transmitted to the injection valves (not illustrated). In the fuel delivery line 7 is arranged an electromagnetic shut-off valve 8, which is urged into its closed position by a spring 17. The electrical supply line 9 to the winding 8*a* of the valve 8 includes a starting switch 10, which is closed when the engine is running, and when closed connects the winding of the shut-off valve 8 to a voltage source 11, whereby the valve 8 is shifted into its open position.

In the exhaust pipe 4 is arranged a lambda lean probe 12, which determines the oxygen content in the exhaust gas and transmits an appropriate signal on line 13 to an electronic comparator system 14, in which the probe signal is compared with a nominal lambda value. If the probe signal is less than the nominal lambda value of, for example, 1.5 (by a pre-selected figure), the electronic comparator system 14 transmits an output signal via line 14*a* to the winding 15*a* of a relay 15, which is in series with the starting switch 10 in the circuit 9 of the cut-off valve 8, whereby its contact blade 16 is shifted from the normal position as illustrated, into the dotted position 16*a*, in which the circuit 9 is broken or connected to earth. The cut-off valve 8 is then closed by the spring 17 and consequently causes the engine 1 to come to a sudden immediate standstill.

It is normal to inject an excess quantity of fuel into the diesel engine during starting, and this leads to a reduction in the quantity of oxygen in the exhaust gas, and since the permitted lambda value may vary in accordance with speed, it is advantageous to store a characteristic with speed-dependent lambda nominal values in the electronic comparator system 14. Such a characteristic is illustrated in FIG. 2. When a speed-dependent signal is fed to the comparator electronic system 14, the latter can now determine the appropriate lambda nominal value for each speed and compare it with the signal from the lambda lean probe 12. In this way the system avoids switching-off the engine in error.

In the modification illustrated in FIG. 3, the halting of the diesel engine 1 is not achieved by cutting off the fuel supply but by cutting off the air supply by means of a shut-off flap valve 21 positioned in the air intake pipe 2 and actuated by an electromagnetic solenoid 20, which is actuated in the closing direction by the electronic comparator system 14 when the stated conditions occur.

In the modification of FIG. 4, by contrast with FIG. 3, an electromagnetically actuated shut-off flap valve 22 is positioned in the exhaust pipe 4 of the engine, the valve being closed by the comparator system 14 when the appropriate conditions exist, so that the engine 1 is brought to a standstill immediately.

In the system illustrated in FIG. 1, the electronic comparator system 14 is arranged to make a determination of the permitted lambda values in dependence upon speed, so as to prevent the engine being brought to a standstill on starting and to permit the injection of an excess quantity of fuel which can occur at this point. Contrary thereto, in the modification of FIG. 5, the electrical line 14A from the comparator system 14 to the relay winding 15*a* includes an electromagnetic switch 25 whose switching element 26 is normally held closed by a spring 27 but is shifted into the open position for starting, so that despite the present of an excess quantity of fuel, the relay 15 is not energized and the shut-off valve 8 remains open. In the supply lead 29 to the winding 28 of switch 25 is arranged a timer 30 which is actuated when the starter switch 10 is closed, and maintains the current supply to the winding 28 for a certain length of time after starting, for example, 1 minute, so that the switch element 26 is held open. After this time interval the circuit 29 is broken by the timer 30 and the switch contact 26 is shifted into the closed position by the spring 27. The electronic comparator system 14 is thus reactivated and disconnects the winding 8*a* of the shut-off valve 8 via the relay 15, if the lambda value falls below the pre-selected figure at which point the shut-off valve 8 is closed by the spring 17 and the fuel supply to the engine 1 is shut off.

I claim:

1. A diesel internal combustion engine comprising an air intake, a fuel injection pump, an exhaust pipe and a device for bringing the engine to a standstill, said device comprising either a means for interrupting the fuel supply to the engine, a means for closing the air intake pipe or a means for closing the exhaust pipe, the improvement including a control comprising a lambda lean probe in the exhaust pipe for determining the oxygen contents in the exhaust gas and generating a signal proportional to said oxygen contents, an engine speed sensor arranged to supply a speed-dependent signal, and an electronic comparator circuit arranged to receive the signals of said lambda lean probe and engine speed sensor and comprising a characteristic curve of speed-dependent lambda nominal values and to compare the lambda actual value determined by said lambda probe with the lambda nominal value at the engine speed sensed by said speed sensor, and to actuate said device if the lambda actual value falls below the lambda nominal value.

* * * * *